United States Patent [19]

Graveman

[11] 3,934,826

[45] Jan. 27, 1976

[54] COAL CRUSHER

[75] Inventor: Donald F. Graveman, St. Charles, Mo.

[73] Assignee: American Pulverizer Company, St. Louis, Mo.

[22] Filed: June 5, 1974

[21] Appl. No.: 476,582

[52] U.S. Cl. ..... 241/81; 241/86.1; 241/196

[51] Int. Cl.[2] ..... B02C 13/09

[58] Field of Search ..... 241/73, 81, 86.1, 88.2, 241/196

[56] References Cited

UNITED STATES PATENTS

| | | | |
|---|---|---|---|
| 759,856 | 5/1904 | Borton | 241/88.2 |
| 1,424,922 | 8/1922 | Knittel | 241/196 X |
| 3,790,093 | 2/1974 | McIntyre | 241/73 |

*Primary Examiner*—Granville Y. Custer, Jr.
*Attorney, Agent, or Firm*—Gravely, Lieder & Woodruff

[57] ABSTRACT

The breaker plate of a coal crusher has holes therein so that coal small enough to pass through those holes does so without being acted upon by the rotor. This increases the capacity of the crusher, reduces fines, and conserves power. The plate is oriented such that windage generated by the rotor urges the smaller pieces of coal through the holes.

7 Claims, 2 Drawing Figures

COAL CRUSHER

BACKGROUND OF THE INVENTION

This invention relates to reducing machines.

Coal as it is taken from the mine is for the most part too large for commercial purposes. In order to bring the mine coal to a commercially acceptable size, the coal is usually run through a coal crusher which normally reduces it to pieces no larger than ¾ to 1 inch in size. However, some of the coal from the mine is already in the ¾ to 1 inch size range and when this coal passes through a crusher, much of it changes to fines which is undesirable. Also, passing the properly sized coal through the crusher reduces the capacity of the crusher and consumes excessive power.

Aside from the foregoing, some of the coal introduced into any crushing machine is merely carried around by the rotor, even though it is small enough to pass through the openings in the screen beneath the rotor. This coal tends to be propelled toward the breaker plates at the inlet of the machine, and then passes over the screen again where it is reduced still further. The end result is likewise an increase in fines and a reduction in the overall capacity of the crusher.

SUMMARY OF THE INVENTION

One of the principal objects of the present invention is to provide a reducing machine which reduces larger pieces of material without converting the smaller pieces to fines. Another object is to provide a reducing machine of the type stated which diverts smaller pieces of material past the rotor so as to increase the capacity of the machine without consuming additional power. A further object is to provide a reducing machine of the type stated which is simple in construction and extremely durable. An additional object is to provide a reducing machine which is ideally suited for crushing coal. These and other objects and advantages will become apparent hereinafter.

The present invention is embodied in a reducing machine having a wall therein toward which the windage of the rotor is directed. The wall has holes in it so that some of the smaller material introduced into the machine passes through the wall without being acted upon by the rotor. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
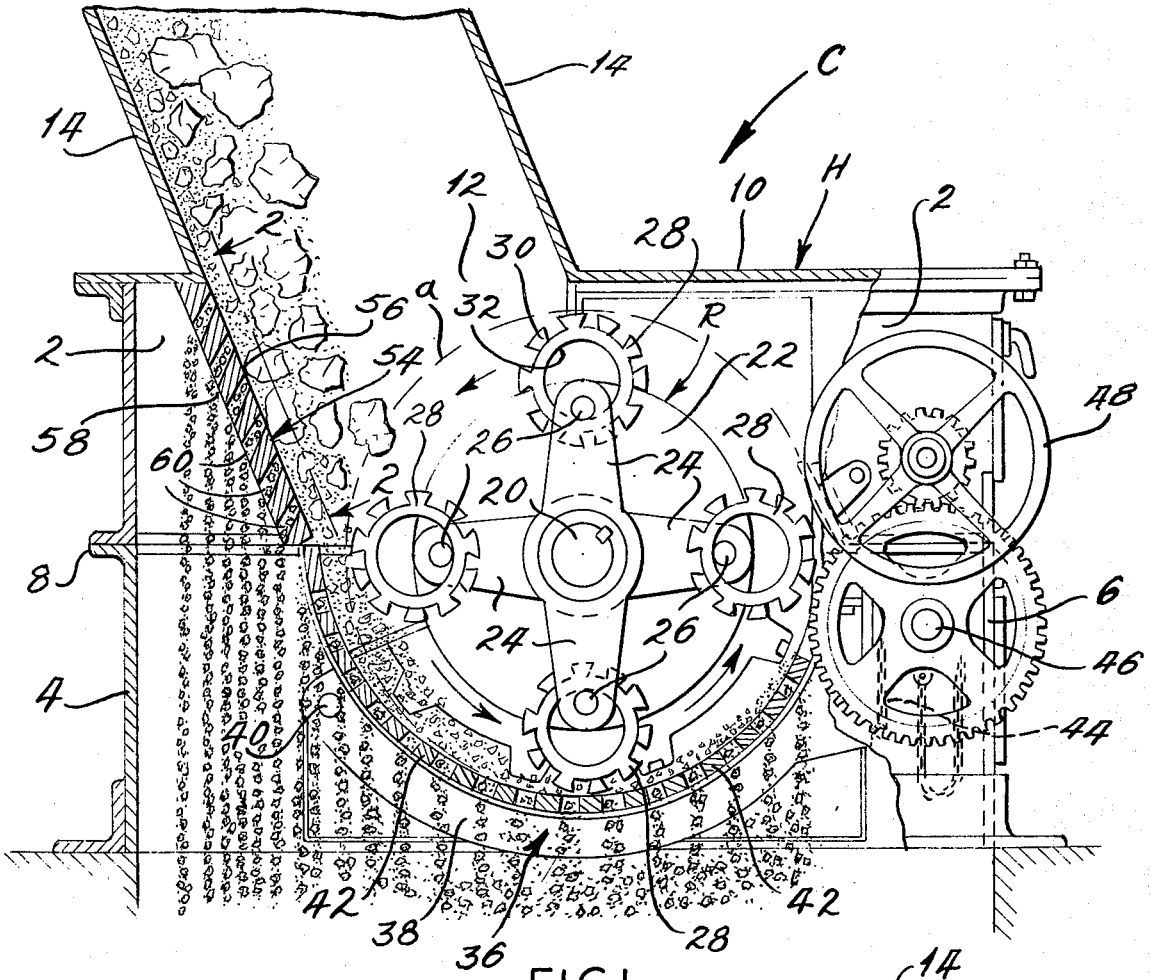
FIG. 1 is a transverse sectional view of a coal crusher constructed in accordance with and embodying the present invention.
Figure 2:
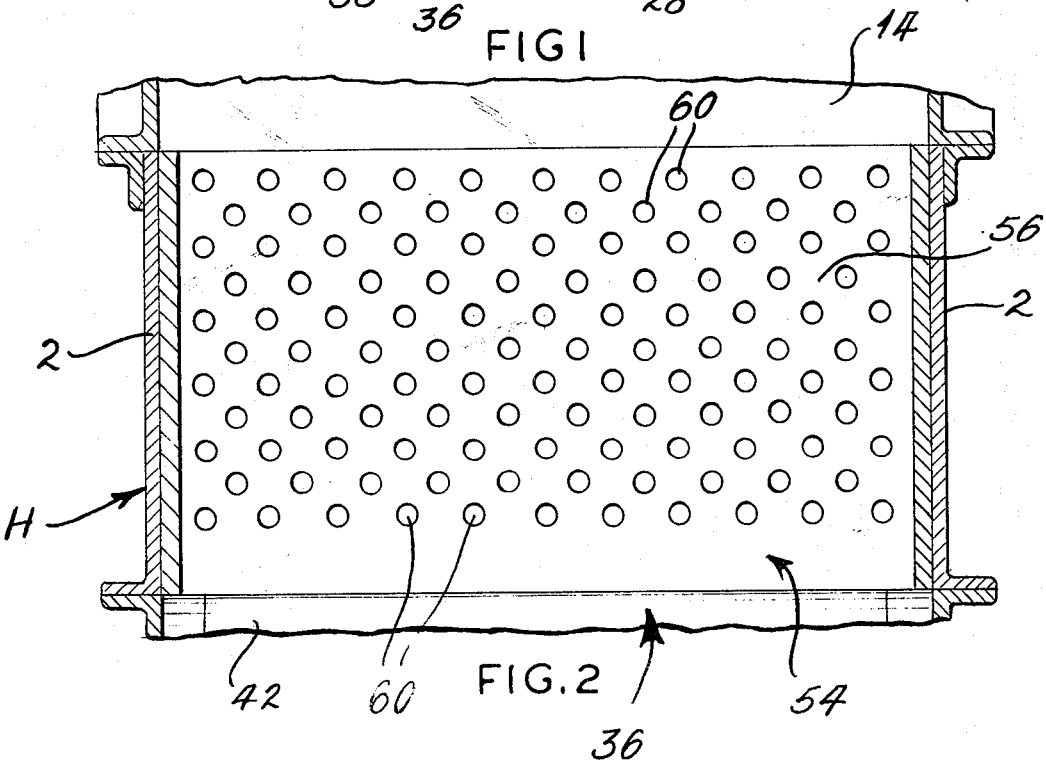
FIG. 2 is a sectional view along lines 2—2 of FIG. 1 and showing the breaker plate.

Referring now to the drawings, a coal crusher C basically comprises a housing H and a rotor R which revolves in the housing H, defining parallel hammer circles *a* of equal size.

The housing H includes spaced apart sidewalls 2 which are parallel and end walls 4 and 6 which extend between the ends of the sidewalls 2. Each of the sidewalls 2 and end walls 4 and 6 is reinforced with ribs 8.

The top of the housing H is closed by a top wall 10 having an inlet opening 12 in it, and this opening is at the bottom of a slightly inclined inlet chute 14. The bottom of the housing H is completely open so that crushed coal can pass easily out of the housing H.

The rotor R extends through the sidewalls 2 of the housing H and includes a rotor shaft 20 which is journaled in pillow blocks supported on the housing H adjacent to the exterior surfaces of the sidewalls 2. Keyed to the shaft 20 adjacent to the interior faces of the sidewalls 2 are end disks 22, and likewise keyed to the shaft 20 between the end disks 22 are a plurality of spiders 24 having radially projecting arms at equal spaced circumferential intervals with the arms of adjacent spiders 24 being spaced axially from each other. The end disks 22 and arms of the spiders 24 have ring shafts 26 extended through them, and these shafts are parallel to the rotor shaft 20 and are spaced outwardly therefrom. The spaces between adjacent spiders 24 are occupied by breaker rings 28, and these rings have radially projecting teeth 30 and relatively large center bores 32 through which the ring shafts 26 extend. The center bores 32 are substantially larger in diameter than the ring shafts 26 and this permits the breaker rings 28 to rotate relative to the spiders 24 and to also retract into the spaces between the spiders 24 in the event an oversized piece of coal or a piece of metal is encountered. Normally, the centrifugal force resulting from the rotation of the rotor R about the axis of the shaft 20 causes the breaker rings 28 to project outwardly to their fullest extent from the spiders 24 and ring shafts 26. When so disposed, the rings 28 describe hammer circles *a*. Thus, the spiders 24 and ring shafts 26 constitute restraining means for causing the breaker rings 28 to rotate with the shaft 20 while holding the rings 26 to the hammer circle *a*.

The housing H contains a cage 36 which is located beneath the rotor R and occupies substantially the entire width of the housing H. The cage 36 includes several arcuate bars 38 which are connected together at one end by a pivot shaft 40, the ends of which are set in bearings located in the sidewalls 2 generally directly below the inlet opening 12. The arcuate bars 38 support screens 42 which are likewise arcuate to conform to the contour of the bars 38. The screens 42 are actually curved steel plates having apertures therein large enough to pass ¾ inch to 1 inch pieces of coal or whatever other size is desired, and as such define an arcuate surface beneath the hammer circle *a*. While one end of the cage 36 is supported at the pivot shaft 40, the opposite end is suspended from chains 44 wound around a winch shaft 46 which is likewise supported in bearings set into the sidewalls 2. The winch shaft 46 is turned by a handwheel 48 located outside the housing H. Thus, when the handwheel 48 is turned, the chains 44 will either wind further around the shaft 46 or unwind from the shaft 46, depending on the direction of rotation. This, of course, changes the position of the cage 36. When the cage 36 is elevated to bring the screens 42 within close proximity of the hammer circles *a*, the size of the coal discharged from the screens 42 is small. When the cage 36 is lowered, the size of the coal increases.

Spanning the space between the inlet opening in the top wall 10 is a flat breaker plate 54 which is inclined at the same angle as the feed chute 14. The plate 54 has a front face 56 presented toward the rotor R and this face aligns at its upper end with the back wall of the feed chute 14, while the lower end of the face 56 generally aligns with the concave face of the uppermost screen 42. Thus, the front face 56 of the breaker plate 54 forms an inclined surface across which coal from the feed chute 14 passes. In this regard, the inclination of the plate 54 is such that the coal slides over the face 56 as it moves toward the rotor R. The plate 54 has a back face 58 presented away from the rotor R.

The breaker plate 54 possesses substantial thickness to withstand the severe impacts resulting from lumps of coal being hurled toward and crushed against it by the shredder rings 28. Moreover, the breaker plate 54 is provided with a series of apertures or holes 60 which extend completely through it and are sized to accommodate pieces of coal as large as ¾ inch to 1 inch or whatever other size is desired from the crushing operation. The axes of the holes 60 are somewhat oblique to the front and back faces 56 and 58 of the plate 54, the inclination being such that the ends of the holes 60 at the front face 56 are considerably higher than the ends at the back face 58. Moreover, the holes 60 are tapered such that they are of lesser cross-sectional area at the front face 56 than at the back face 58 to prevent coal from clogging them. Practically any cross-sectional configuration is acceptable for the holes 60, as long as it will pass coal of the desired size or smaller. For example, the holes 60 may be circular in cross-section, or they may be hexagonal. They may also be in the form of slots oriented longitudinally or transversely of the breaker plate 54.

OPERATION

In use the rotor R is rotated in the direction which causes the shredder rings 28 to move from the top center of the housing H toward the breaker plate 54 and thence along the cage screens 42. When so rotated, the rotor R generates a limited amount of windage immediately below the inlet opening 12, and this windage is directed toward the front face 56 of the breaker plate 54.

Coal from a mine is introduced into the crusher through the feed chute 14 and the coal is for the most part composed of relatively large lumps, although it does contain some fines and some pieces the desired size, which is usually ¾ inch to 1 inch wide. Upon leaving the chute 14, the coal passes directly over the front face 56 of the breaker plate 54, where many of the smaller pieces fall through the holes 60 and thence through the interior of the housing H to be collected below the housing H. The windage generated by the rotor R, being directed toward the front face 56 of the plate 54, acts upon the coal and assists in diverting many of the smaller pieces of the coal into the holes 60 and through the breaker plate 54. Thus, much of the coal introduced into the crusher C from the feed chute 14 does not reach the rotor R, but is instead diverted through the breaker plate 54.

The remainder of the coal, which is mostly the larger lumps, passes into the paths of the breaker rings 28 which reduce those lumps to smaller sizes. Indeed, the rings 28 rake the large lumps along the screens 42 of the cage 36, reducing those lumps as they do, and when reduced sufficiently the coal passes through the apertures in the screens 42 and is collected below the housing H.

Most of the larger lumps are reduced sufficiently to pass through the screen 42 by the time that coal reaches that end of the cage 36 suspended by the chains 44, and does in fact pass through the screens 42. However, some of the coal is carried around by the rotor R and hurled toward the breaker plate 54. This coal stands a good chance of passing through the holes 60 in the breaker plate 54 without again being dragged along the cage screens 42.

Thus, much of the coal introduced into the crusher C is not acted upon by the rotor R in the sense that the breaker rings 42 engage that coal and rake it along the screens 42. Instead, the coal passes through the holes 60 in the breaker plate 54. As a result, the crusher C has greater capacity than conventional crushers of the comparable size. It can also pass more coal for the same amount of power.

Since the holes 60 are tapered, there is little tendency for them to clog.

This invention is intended to cover all changes and modifications of the example of the invention herein chosen for purposes of the disclosure which do not constitute departures from the spirit and scope of the invention.

I claim:

1. A machine for reducing lump material such as coal, said machine comprising: a rotor which revolves about an axis of rotation in one direction, generating windage as it does, the rotor having breaking elements which describe a hammer circle as the rotor revolves and are capable of moving inwardly toward the axis of rotation upon encountering oversize lumps; a housing supporting the rotor and enclosing the hammer circle, the housing having an upwardly presented opening located above the hammer circle and substantially entirely on that side of the axis along which the breaking elements descend; an apertured cage within the housing and spaced from the lower portion of the hammer circle, the cage being arcuate and generally corresponding in contour to the hammer circle so that large lumps of material introduced into the opening are crushed between the cage and breaking elements and reduced to a predetermined size small enough to pass through the apertures in the cage; and a generally flat apertured plate located between the opening and the upper end of the cage on that side of the axis at which the breaking elements descend and being close enough to the rotor to enable the windage generated by the rotor to impinge against it, the apertured plate forming an upward generally uninterrupted continuation of the cage and being inclined with respect to the vertical such that much of the lump material entering the opening will fall onto and pass over the apertured plate, the apertured plate having holes therein sufficient in size to permit passage of material of substantially said predetermined size but not larger, the apertured plate and holes therein extending above the hammer circle, whereby much of the material which is of the predetermined size or smaller will fall through the apertured plate before being impacted by the breaking elements with the windage assisting the passage through the apertured plate, while material larger than the predetermined size will be impacted by the breaking elements and moved along the cage until small enough to pass through the cage.

2. A reducing machine according to claim 1 wherein the apertured plate has a front face presented toward the rotor and a back face presented away from the rotor; and wherein the cross-sectional area of each hole is greater at the back face than at the front face to prevent the holes from clogging.

3. A reducing machine according to claim 1 wherein the apertured plate has a front face presented toward the rotor and a back face presented away from the rotor, and wherein each hole is oblique to the faces with the end thereof at the front face being substantially above the end thereof at the back face.

4. A reducing machine according to claim 1 wherein the breaking elements are rings which are free to rotate relative to the rotor as the rotor revolves.

5. A coal crusher comprising: a housing having a top provided with an inlet opening; a rotor including a shaft carried by the housing and rotatable in one direction about an axis of rotation which is fixed with respect to the housing, the axis of rotation being located beneath and to one side of the opening so that the axis is not directly beneath the opening, the rotor further including breaker elements and restraining means mounted rigidly on the shaft and within the housing for causing the elements to rotate with the shaft so as to describe a hammer circle as the rotor revolves, the restraining means permitting the breaker elements to move inwardly a limited distance toward the shaft, the direction of rotation for the rotor being such that the breaker elements descend beneath the opening in the housing; an inclined chute connected to the housing at the opening for directing the lumped material into the housing; a cage in the housing generally beneath the hammer circle, the cage being curved and generally following the contour of the hammer circle, the cage further being spaced from the hammer circle and having apertures to permit the lump material to pass through it once the lump material reaches a predetermined size; and an apertured plate extended between the opening and the cage and being positioned close enough to the rotor so that windage generated by the rotor impinges against it, the apertured plate being generally flat and forming a generally uninterrupted continuation of the chute in the downward direction and a generally uninterrupted continuation of the cage in the upward direction, the apertured plate being inclined with respect to the vertical such that a major portion of the lump material leaving the chute will pass over it, the apertured plate having apertures therein which permit the lump material of said predetermined size or smaller to pass through the plate, the plate and apertures therein extending higher than the hammer circle, whereby much of the lump material which is small enough to pass through the apertures of the apertured plate will do so with assistance from the windage generated by the rotor before being impacted by the breaker elements, while larger lump material will be moved over the cage by the breaker elements and when small enough will pass through the apertures in the cage.

6. A coal crusher according to claim 5 wherein the apertured plate has a front face presented toward the rotor and a back face presented away from the rotor, and the axes of the apertures in the plate are oblique to the front and back faces of the plate with the ends of the apertures at the front face being substantially higher than the ends at the back face.

7. A coal crusher according to claim 6 wherein the apertures in the apertured plate are tapered with their ends at the front face being smaller than their ends at the back face.

* * * * *